United States Patent [19]

Dinkelmann

[11] Patent Number: 4,703,618

[45] Date of Patent: Nov. 3, 1987

[54] SPINNING AND SPOOLING APPARATUS

[75] Inventor: Friedrich Dinkelmann, Rechberghausen, Fed. Rep. of Germany

[73] Assignee: Zinser Textilmaschinen GmbH, Ebersbach, Fed. Rep. of Germany

[21] Appl. No.: 870,644

[22] Filed: May 28, 1986

Related U.S. Application Data

[63] Continuation of Ser. No. 815,180, Dec. 23, 1985, abandoned, which is a continuation of Ser. No. 656,594, Oct. 1, 1984, abandoned.

[30] Foreign Application Priority Data

Oct. 1, 1983 [DE] Fed. Rep. of Germany ..... 3335753

[51] Int. Cl.[4] ..... D01H 9/04; D01H 9/18

[52] U.S. Cl. ..... 57/276; 57/281; 242/35.5 A

[58] Field of Search ..... 57/266, 267, 273, 274, 57/275, 276, 281; 242/35.5 A; 198/747, 485, 550, 651; 414/37, 131

[56] References Cited

U.S. PATENT DOCUMENTS

| | | | |
|---|---|---|---|
| 3,154,909 | 11/1964 | Urano et al. | 57/275 X |
| 3,195,298 | 7/1965 | Fürst | 242/35.5 R X |
| 4,066,218 | 1/1978 | Kamp | 242/35.5 A |
| 4,162,724 | 7/1979 | Shinjo | 198/747 X |
| 4,181,228 | 1/1980 | Hashimoto et al. | 242/35.5 A |
| 4,338,778 | 7/1982 | Suzuki et al. | 57/276 |
| 4,432,198 | 2/1984 | D'Agnolo | 242/35.5 A X |
| 4,480,740 | 11/1984 | Würmli | 242/35.5 A X |

FOREIGN PATENT DOCUMENTS

| | | | |
|---|---|---|---|
| 938840 | 10/1963 | United Kingdom | 242/35.5 A |

*Primary Examiner*—Stuart S. Levy
*Assistant Examiner*—Joseph J. Hail, III
*Attorney, Agent, or Firm*—Karl F. Ross; Herbert Dubno

[57] ABSTRACT

A spinning and spooling apparatus includes a spinning frame which has two sides each associated with a magazine for tubes which are conveyed through the spinning frame to provide respective spinning cops which are forwarded to an associated spooler. The spooler discharges the empty tubes which are then returned to the magazines by a feedback unit. The feedback unit includes a conveyor running from the spooler to the magazines and a controllable distributing guide which selectively provides a connection between the conveyor and one of the magazines.

4 Claims, 9 Drawing Figures

SPINNING AND SPOOLING APPARATUS

This is a continuation of co-pending application Ser. No. 815,180, filed on Dec. 23, 1985, which is a continuation of Ser. No. 656,594, filed Oct. 1, 1984, both of which are now abandoned.

FIELD OF THE INVENTION

My present invention relates to the recycling of bobbin or spool tubes, cores or sleeves and in particular to a spinning and spooling apparatus provided with such a feedback or recycling unit.

BACKGROUND OF THE INVENTION

Conventional spinning and spooling apparatus provided with a ring spinning frame and a spooler have the common disadvantage of waiting periods for return of the empty cores, sleeves or tubes upon which the bobbin is wound and from which the yarn is removed because the demand for tubes of the spinning frame is sometimes higher than the discharge by the spooler or because the spooler must be stopped because the spinning frame cannot process a temporary oversupply of tubes.

OBJECTS OF THE INVENTION

It is the principal object of my present invention to provide an improved spinning and spooling apparatus obviating the aforestated drawbacks.

Another object is to provide an apparatus of the type described with improved means for recycling the bobbin-winding tubes.

SUMMARY OF THE INVENTION

I realize these objects, in accordance with the present invention, by providing a feedback or recycling unit which includes a magazine for each side of the spinning frame cooperating with a conveyor in such a manner that tubes discharged from the spooler are selectively returned to one of the magazines by the conveyor. To provide this selective feeding of tubes into the magazines, a controllable distributing guide or branch is used which can selectively be brought into alignment or communication with each of the magazines depending which one has a demand for the recycled tubes.

Through the provision of such a feedback unit the spinning and spooling apparatus can be continuously operated without any of the aforementioned problems since the use of the magazines provides a buffer for the tubes.

BRIEF DESCRIPTION OF THE DRAWING

The above and other objects, features and advantages of my present invention will become apparent from the following description, reference being made to the accompanying drawing in which.

SPECIFIC DESCRIPTION

Figure 1:
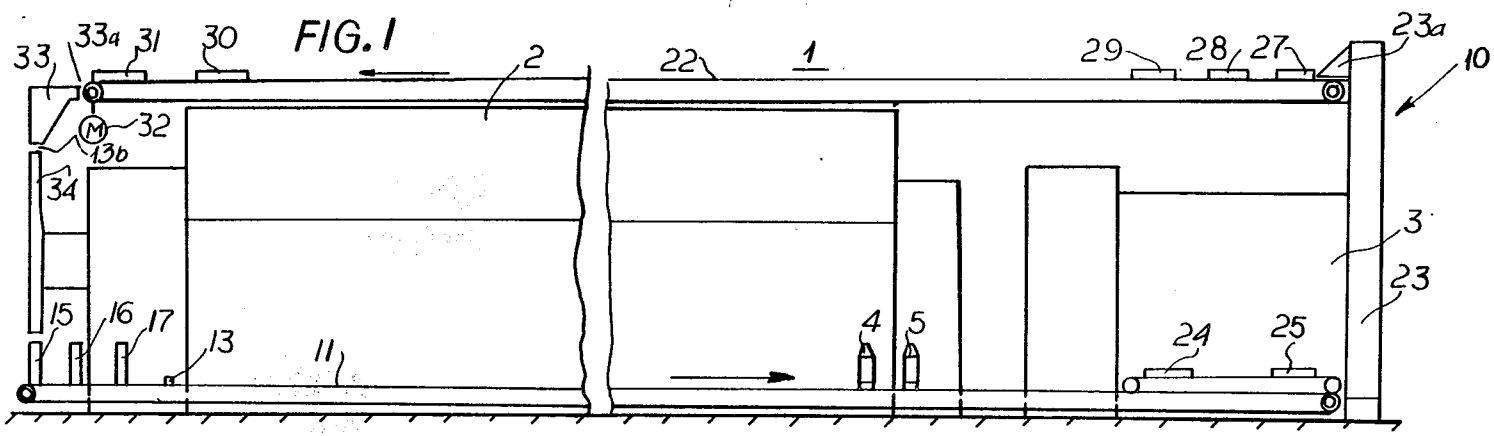
FIG. 1 illustrates schematically a side view of a first embodiment of a spinning and spooling apparatus according to the invention.
Figure 2:
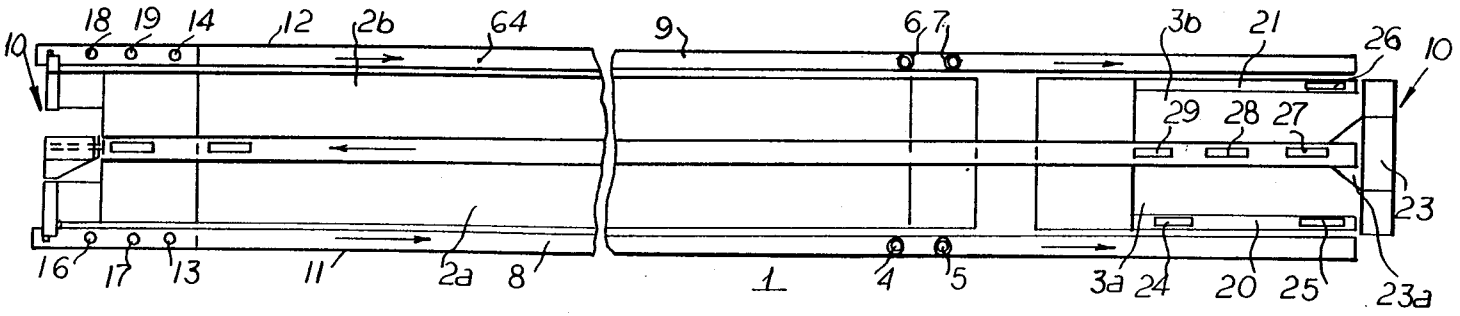
FIG. 2 is a top view of the apparatus of FIG. 1.

FIGS. 1 and 2 show a first embodiment of a spinning and spooling apparatus 1 and including a ring spinning frame 2 which is double-sided so as to have a frame side 2*a* and a frame side 2*b*.

Adjacent to one end of the spinning frame 2, the apparatus 1 has a spooler 3 which is also double-sided to define sides 3*a* and 3*b*.

Arranged along the frame side 2*a* is a first conveyor 8 and along the frame side 2*b* is a second conveyor 9 for forwarding a plurality of bobbin tubes and formed spinning cops, e.g. cops 4, 5 and 6, 7 (bobbins/yarn such tubes) along the spooler 3. Both conveyors 8, 9 are provided with respective endless belts 11, 12 and extend beyond the front portion of the spinning frame 2.

Thus each of the belts 11, 12 constitutes also a tube magazine which operates as a buffer for the tubes entering the spinning frame 2. Along each belt 11, 12, a plurality of pegs or pins, e.g. pins 13, 14, are uniformly spaced which receive empty tubes 15, 16, 17, 18, 19 when the latter are in the magazine portion of the respective belt 11, 12. Consequently, these tubes fitted onto the pins constitute the tube stock until being forwarded to the spinning frame 2.

For returning tubes discharged by the spooler 3, the apparatus 1 is provided with a feedback or recycling unit 10. The feedback unit 10 includes an upright elevator 23 arranged at the end face of the spooler 3 remote to the spinning frame 2 and is provided to lift the tubes from an upper level.

At each side 3*a*, 3*b* of the spooler 3, the elevator 23 is associated with a conveyor 20 and 21, respectively, along which the empty tubes are introduced into the elevator 23. The conveyors 20, 21 run parallel to the conveyors 8, 9 and are also designed as belt conveyors. The upper portion of the elevator 23 is provided with a spout 23*a* which cooperates with a further conveyor 22 (FIG. 1) along which the empty tubes discharged from the spooler 3 are returned to the respective tube magazines 11 and 12.

As can be seen from FIGS. 1 and 2, tubes 24, 25, 26 are about to enter the elevator 23 so as to be lifted and placed onto the conveyor 22 while tubes 27, 28, 29 have already been placed thereon. In order to prevent a congestion of tubes when being delivered by both conveyors 20, 21, it is possible for example to provide such a distance between two subsequent tubes on one conveyor that in between these two tubes a further tube from the other conveyor can be placed upon being discharged onto the conveyor 22.

The conveyor 22 which is also provided as a belt conveyor extends at a higher level above the apparatus 1 from the spout 23*a* to beyond the spinning frame 2 and is driven by a controllable stepper motor 32.

Cooperating with the end portion of the upper run of the conveyor 22 which end portion is remote from the spout 23*a*) is a distributing guide or selection branch 33 through which tubes displaced by the conveyor 22 to the end portion of the upper run —as tubes 30 and 31— can be selectively supplied to either one of the tube magazines 11 or 12. The guide 33 is funnel-shaped and has a stationary inlet 31*a* aligned with the upper run of the conveyor 22 and an outlet 33*b* which is movable in direction of arrow 36, (FIG. 5) between two end positions. Due to the funnel shape of the guide 33 the tubes which are forwarded horizontally along the conveyor 22 are supplied to the associated pins 13 or 14 in a vertical position.

The actuation of the guide 33 is dependent on the contents and on the advancement motion of one of the tube magazines 11, 12. Thus the exposed pins of one tube magazine are at first covered by the tubes and then the pins of the other magazine will be provided with respective tubes. It is, however, also possible to alternatingly or in any other arbitrary sequence provide exposed pins 13, 14 of the associated magazines with recycled tubes.

Figure 5:
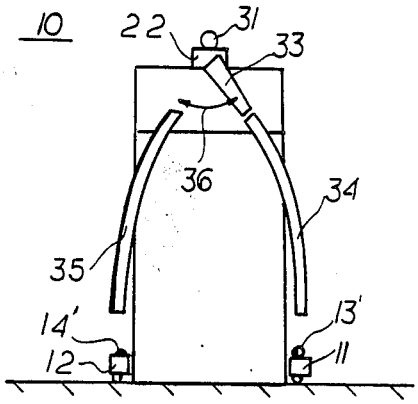
FIG. 5 is a front view of the apparatus of FIG. 1.

Referring now to FIG. 5, it can be seen that the guide 33 cooperates with two loading chutes 34, 35 each of which is in alignment with the guide 33 when the latter is moved in direction of arrow 36 between its end positions. The loading chutes 34, 35 are each curved so as to have an outlet positioned above the exposed pin—in FIG. 5 pins 13' or 14'—in order to fit a tube over it.

In FIG. 5, a tube 31 is about to be introduced into the guide 33 which is in alignment with the chute 34 so that the tube 31 will be positioned over the pin 13' of the magazine 11 and is then forwarded along the conveyor 8.

Figure 8:
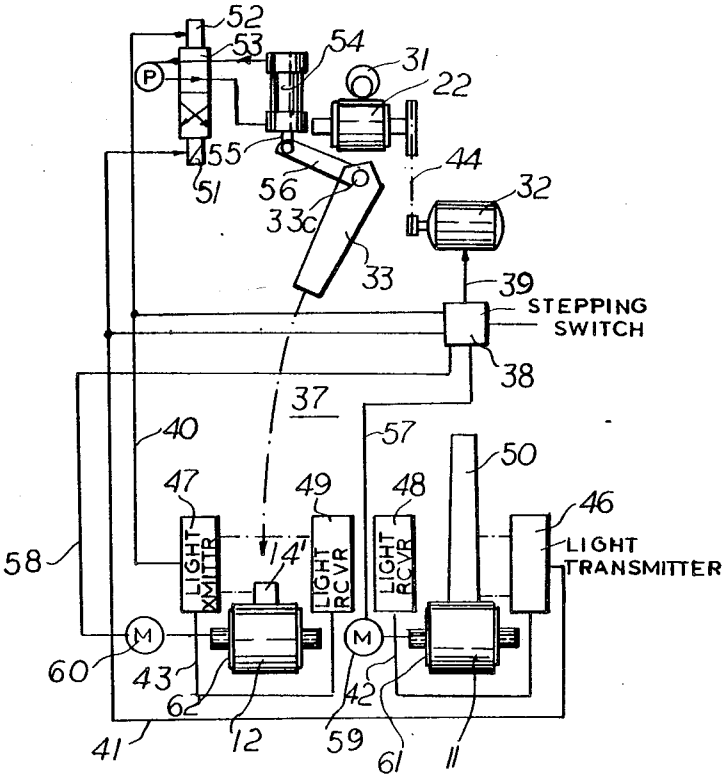
FIGS. 7 and 8 show details of a bobbin tube feedback unit associated to the apparatus of FIG. 1.

The actuation of the distributing guide 33 is provided by a control unit 37 which will now be described in connection with FIGS. 7 and 8. Accordingly, the control unit 37 includes a step-by-step switch box 38 (stepping switch) which is connected to the stepper motor 32 via line 39. Via tractive means 44, the stepper motor 32 drives a roller 45 to which the belt of the conveyor 22 is connected so as to drive the latter in a desired manner.

Arranged below each of the chutes 34, 35 and above each tube magazine 11, 12 is a light curtain or barrier each consisting of a light transmitter 46; 47, and a light receiver 48; 49, respectively. The light transmitters 46, 47 generate two light beams one above another at such a distance that the upper light beam is interrupted when a tube is positioned on an associated pin while the lower light beam is interrupted when a pin is located in front of the light transmitter 46, 47 (FIG. 8).

Via a line 42, the light transmitter 47 is connected to the light receiver 49 via line 43. The step-by-step switch 38 is connected with the light transmitter 46 via a line 41 and with the light transmitter 47 via a line 40. The lines 40 and 41 lead also to an associated switching magnet 51, 52 of a directional control valve 53 which is in communication with a pneumatic servomotor 54. The servomotor 54 is provided with a piston rod 55 which is fixed to one end of a control lever 56 whose other end is connected to the distributing guide 33 via a pivot 33*c*.

In communication with the switch 38 is still further a line 57 leading to a motor 59 which drives the conveyor 8 and thus the tube magazine 11 via a drive roller 61. In similar manner, a motor 60 is provided which drives the conveyor 9 and thus the magazine 12 via a drive roller 62 and which is controlled by the switch 38 via a line 58.

Figure 7:
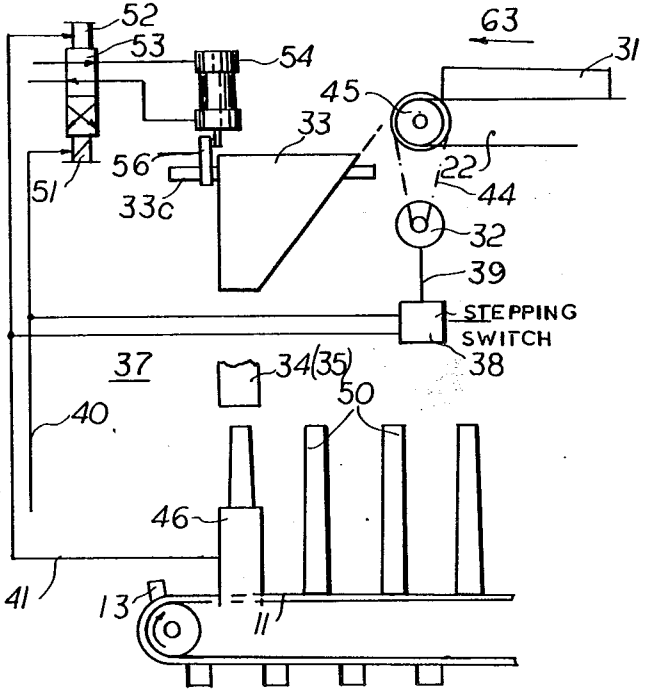

Assuming the tube magazine 11 has been furnished with tubes 50 as indicated in FIG. 7, and there is no need to provide further tubes to this magazine 11, the conveyor 8 will be stopped so that the two light beams generated by the light transmitter 46 are interrupted.

Consequently, the guide 33 can be switched into a position in which it is in alignment with the chute 35 to allow tubes to be furnished to the magazine 12. The tube 31 is already positioned at the forward end of the conveyor 22. When the pin 14' enters the light barrier 47–49, the lower light beam is interrupted and an impulse is sent to the switch box 38 and simultaneously to the switching magnet 52 via the line 40. Consequently, the directional control valve 53 is switched into the position shown in FIG. 8 which means that compressed air is introduced by an air pressure source P into the servomotor 54 so as to retract the piston rod 55.

The retraction of the piston rod 55 is transmitted via the lever 56 onto the guide 33 which is then in alignment with the chute 35. The switch 38 then excites the stepper motor 32 via the line 39 to move the conveyor 22 about one step or switch cycle in direction of arrow 63. Since one switch cycle corresponds to the forwarding of one tube into the respective chute, the tube 31 will thus be forced into the guide 33 and through the chute 35 onto the aligned pin 14'. This causes an interruption of the upper light beam of the light barrier 47–49 as well which emits an impulse to the switch box 38 via line 40. This impulse actuates the switch 38 to actuate the stepper motor 60 for moving the conveyor 9 and thus the belt-shaped tube magazine 12 in direction of arrow 64 until the next following pin 14 enters the light barrier 47–49.

During the forward movement the guide maintains its respective position, in the present case the alignment with chute 35. When the next following pin 14 interrupts the lower light beam emitted by the light transmitter 47, the described cycle will be repeated until a furnished tube interrupts the upper and lower beams of the light transmitter 47 and remains in this position. Then, a possible demand of tubes by the other magazine 11 can be met.

Figure 3:
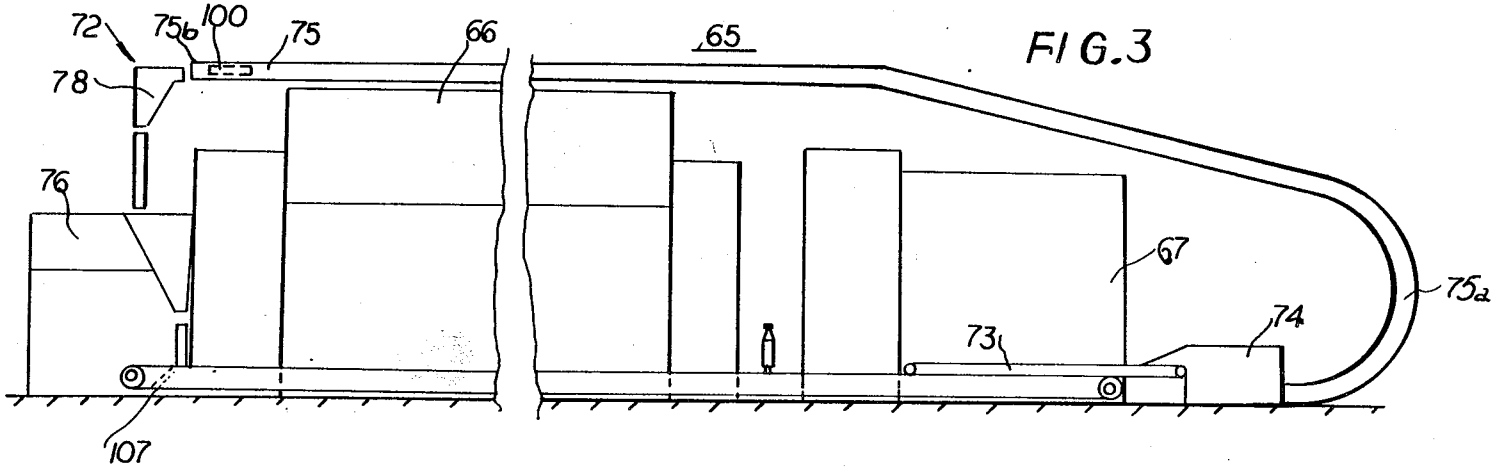
FIG. 3 is a schematic side view of a second embodiment of the spinning and spooling apparatus according to the invention.
Figure 4:
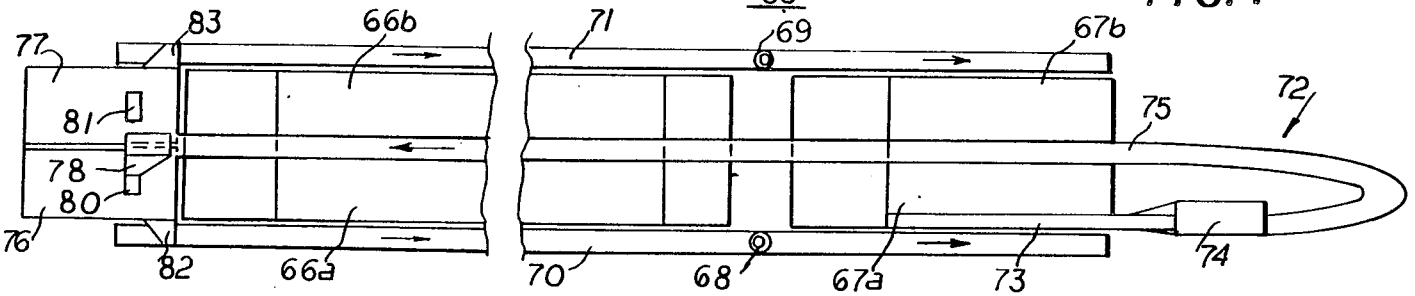
FIG. 4 is a top view of the apparatus of FIG. 3.

Turning now to the second embodiment as illustrated in FIGS. 3 and 4, it can be seen that a spinning and spooling apparatus 65 includes a double-sided ring spinning frame 66 having frame sides 66*a*, 66*b*. Following the ring spinning frame 66 is a spooler 67 which is also double-sided with the spooler sides 67*a*, 67*b*. Along one side of the ring spinning frame 66 and the spooler 67 extends a conveyor 70 which forwards the tubes and the formed spinning cops like spinning cop 68. In a similar manner, the other side of the ring spinning frame 66 and the spooler 67 is provided with a conveyor 71 which forwards the tubes and formed spinning cop 69 along the spooler 67. Running parallel to the conveyor 70 and associated with the spooler 67 is a further conveyor 73 for receiving the tubes discharged by the spooler 67. The conveyor 73 is part of a feedback unit 72 for returning the tubes to the front portion of the ring spinning frame 66 and is provided in form of a belt conveyor.

Associated with the conveyor 73 is an intermediate storage unit 74 and a conveying pipe 75 which has a curved portion 75*a* so that the actual pipe 75 runs above the spooler 67 and spinning frame 66 to the forward portion of the latter. At the outlet 75*b*, the pipe 75 is aligned with a distributing guide 78 which selectively feeds tubes 100 to one of two tube magazines 76, 77. The guide 78 is funnel-shaped so that the tubes 100 that are horizontal at the outlet 75*b* of the pipe 75 are supplied to the respective magazine in a vertical or upright position.

Figure 6:
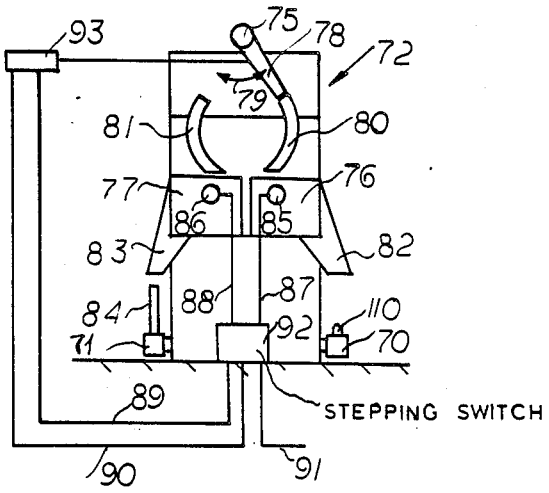
FIG. 6 is a front view of the apparatus of FIG. 3.

As indicated in FIG. 6 by arrow 79, the guide 78 swivels between two end positions in each of which, the guide 78 is in alignment with one end of a loading chute 80, 81. The other end of the loading chute 80 is arranged above the tube magazine 76, while the other end of the loading chute 81 opens above the magazine 77. To each of the tube magazines 76, 77 is associated a further loading chute 82, 83 through which the tubes are furnished onto the respective conveyors 70, 71 which forward the tubes to the ring spinning frame 66 to provide the spinning cops. After being discharged out of the spooler 67, the tubes are then returned through pipe 75 to the guide 78 which is controlled in a manner to be described hereinafter.

Each of the magazines 76, 77 contains a predetermined stock of tubes which is monitored by the light barriers 85 and 86, respectively. The light barriers each communicate via respective lines 87, 88 with a step-by-step switch 92 which is further connected via lines 89, 90 to a servomotor 93 of the guide 78. Depending on the impulse sent by the switch 92, the servomotor 93 will cause the guide 78 to occupy either one of its end positions. Via line 91, the switch 92 is connected with the intermediate storage unit 74 which is illustrated in particular in FIG. 9.

Accordingly, the storage unit 74 is provided with an intermediate magazine 94 which collects the tubes 95 forwarded by the conveyor 73 from the spooler 67. At its lower end, the magazine 94 is provided with an outlet 101 to the conveying pipe 75 which is completely filled with tubes as indicated by tubes 97, 98, 99. Opposite to the outlet 101, the magazine 94 is provided with an opening 108 through which a piston 103 of a cylinder 102 can penetrate. The cylinder 102 is pneumatically actuated and communicates with a bidirectional control valve 104 which in turn is connected to a compressed air source 105. The valve 104 is provided with a switching magnet 106 which is connected via the line 91 to the switch box 92. Through spring means 109, the bidirectional control valve is reset.

Assuming the switch box 92 is informed by the light barrier 86 via line 88 that the tube magazine 77 is sufficiently filled with tubes, however, but that the light barrier 85 determines that the magazine 76 lacks some tubes, a corresponding signal is transmitted to the switch box 92 which activates the servomotor 93 to move the guide 78 in alignment with the chute 80 as shown in FIG. 6. Further, the switch box 92 transmits a signal to the switching magnet 106 of the directional control valve 104 for actuating the cylinder 102.

Figure 9:
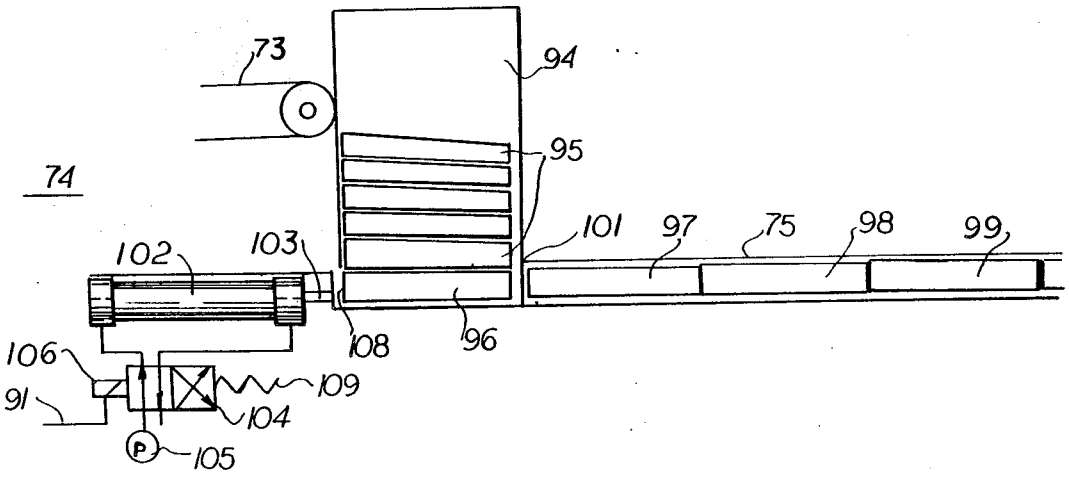
FIG. 9 illustrates an intermediate tube storage unit associated with the apparatus of FIG. 3.

Accordingly, the control valve 104 will occupy the position as shown in FIG. 9 and the piston 103 will be shifted to the right to move the tube 96 located at the bottom of the magazine 94 through the outlet 101 into the pipe 75.

Simultaneously with the introduction of the tube 96, all the other tubes located within the pipe 75 are advanced thus forcing the tube 100 (FIG. 3) at the outlet **75*b* of the pipe 75 into the guide 78 and through the chute 80 into the tube magazine 76**.

In case the light barrier 85 still determines that there is a lack of tubes, the switch box 92 causes a further operating cycle as described until the light barrier determines that a sufficient accumulation of tubes in the tube magazine 76 has occurred.

The transfer of the tubes from the magazines 76, 77 onto the respective conveyors 70, 71 is obtained e.g. in steps by using a modified step-by-step switch system similar to the one described in connection with FIGS. 7 and 8. The conveyors 70, 71 are also provided with a plurality of pins 110 which are uniformly spaced along each conveyor belt and are aligned with the chute 82, 83 of the associated tube magazine 76, 77.

I claim:

1. An apparatus for feeding back reusable articles discharged from a double-sided machine having a front portion and a rear portion, said apparatus comprising:

respective front-to-rear conveyors extending along the sides of said machine for conveying said articles from said front portion to said rear portion thereof, each of said front-to-rear conveyors forming at least one primary magazine for the articles associated with each side of said machine;

means including a storage unit at said rear portion of said machine for receiving said articles from said front-to-rear conveyors and for holding the received articles in a stack;

a rear-to-front conveyor for guiding discharged articles from said storage unit to said front portion of said machine;

a distributing guide movable at said front portion of said machine between two end positions respectively connecting said rear-to-front conveyor at said front portion to the respective primary magazines;

drive means for discharging articles from said stack in said storage means into said rear-to-front conveyor and for displacing said articles along said rear-to-front conveyor in steps in each of which an article is discharged into said distributing guide;

respective light barriers at said primary magazines for detecting when the magazines require filling with said articles; and control means connected to said drive means, said light barriers and said distributing guide for selectively moving said distributing guide between said end positions so as to connect said rear-to-front conveyor with each of said primary magazines in dependence upon the demand for said articles by the respective primary magazines as determined by the respective light barriers and for stepping said articles along said rear-to-front conveyor and then into said distributing guide and finally to said front-to-rear conveyors, said storage unit including:

an intermediate magazine receiving said stack and having an outlet at a lower end thereof allowing only a single article from the stack to be discharged at a time, said control means including a stepping switch, and a servomotor connected to said switch and coupled with said distributing guide for shifting same between said positions, said light barriers being connected with said switch for triggering same, each of said light barriers indicating the degree of filling of the respective primary magazine, said drive means including:

a cylinder having a plunger engageable with an article at the bottom of said stack for displacing it through said outlet, and a directional control valve connected to said cylinder for operating same, said valve being connected to and operated by said switch.

2. The apparatus defined in claim 1 wherein said rear-to-front conveyor and said front-to-rear conveyors are each a belt conveyor.

3. The apparatus defined in claim 1 wherein said rear-to-front conveyor is a conveying pipe.

4. The apparatus defined in claim 1 wherein said distributing guide is funnel-shaped and has a stationary inlet aligned with said rear-to-front conveyor and an outlet movable between said positions so as to be alignable with each of said magazines.

* * * * *